US006993843B2

(12) United States Patent
Quaintance et al.

(10) Patent No.: US 6,993,843 B2
(45) Date of Patent: Feb. 7, 2006

(54) RAIL BRACKET MOUNTING SYSTEM WITH LOCKING PIN

(75) Inventors: Randy R. Quaintance, York, NE (US); Ronald R. West, Alpine, UT (US)

(73) Assignee: Kroy Building Products, Inc., York, NE (US)

( * ) Notice: Subject to any disclaimer, the term of this patent is extended or adjusted under 35 U.S.C. 154(b) by 0 days.

(21) Appl. No.: 10/818,632

(22) Filed: Apr. 5, 2004

(65) Prior Publication Data

US 2004/0261243 A1 Dec. 30, 2004

Related U.S. Application Data

(60) Division of application No. 10/165,177, filed on Jun. 6, 2002, which is a continuation of application No. 10/039,234, filed on Dec. 31, 2001, now abandoned, which is a continuation of application No. 09/919,502, filed on Jul. 31, 2001, now abandoned, which is a continuation-in-part of application No. 09/844,846, filed on Apr. 28, 2001, now abandoned.

(51) Int. Cl.
*B23P 11/02* (2006.01)

(52) U.S. Cl. ..... 29/897.31; 29/433; 29/453; 29/525.03

(58) Field of Classification Search ..... 29/453, 29/433, 897.31, 525.03, 525.08
See application file for complete search history.

(56) References Cited

U.S. PATENT DOCUMENTS

| | | | | |
|---|---|---|---|---|
| 2,336,385 A | | 12/1943 | Batcheller | |
| 2,590,929 A | | 4/1952 | Bush | |
| 3,107,900 A | | 10/1963 | De Paolo | |
| 3,156,282 A | | 11/1964 | Bedford, Jr. | |
| 3,208,778 A | | 9/1965 | Gordon | |
| 3,212,754 A | | 10/1965 | Revell et al. | |
| 3,278,149 A | | 10/1966 | Brucker | |
| 3,385,567 A | | 5/1968 | Case et al. | |
| 3,498,589 A | | 3/1970 | Murdock et al. | |
| 3,506,243 A | | 4/1970 | Seiler | |
| 3,752,262 A | * | 8/1973 | Helms | 256/59 |
| 4,101,226 A | | 7/1978 | Parisien | |
| 4,114,861 A | | 9/1978 | Long | |
| 4,124,198 A | | 11/1978 | Wong | |
| 4,135,837 A | | 1/1979 | Suttles | |
| 4,165,944 A | | 8/1979 | Sunasky | |

(Continued)

FOREIGN PATENT DOCUMENTS

| | | |
|---|---|---|
| CA | 1035983 | 8/1978 |

(Continued)

OTHER PUBLICATIONS

Declaration of John T. Forbis Regarding Non-Documentary Information Publicly Available Prior to Earliest Filing Date.

*Primary Examiner*—David P. Bryant
(74) *Attorney, Agent, or Firm*—Clayton, Howarth & Cannon, P.C.

(57) ABSTRACT

A rail bracket mounting system, including a bracket that is attached to a post. The bracket is formed to support the notching of a rail. The end of a rail is then nested into the bracket, and is supported by the bracket. The rail is then secured to the bracket by fasteners such as screws, and a cover may then be placed over the bracket, housing the securing fasteners. The rail may be hollow or solid. A hollow rail may be reinforced along its entire length by the insertion of one or more reinforcing members through a hollow portion of the rail.

25 Claims, 7 Drawing Sheets

U.S. PATENT DOCUMENTS

| | | | | |
|---|---|---|---|---|
| 4,280,686 | A | 7/1981 | Wack | |
| 4,368,875 | A | 1/1983 | Weiss et al. | |
| 4,369,953 | A | 1/1983 | Greiner et al. | |
| 4,616,950 | A | 10/1986 | Morris | |
| 4,625,948 | A | 12/1986 | Lustvee | |
| 4,667,935 | A | 5/1987 | Moore | |
| 4,856,252 | A | 8/1989 | Cornell | |
| 4,919,394 | A | 4/1990 | Otte et al. | |
| 4,923,176 | A | 5/1990 | Heinz | |
| 4,958,399 | A | 9/1990 | Toal et al. | |
| 5,101,540 | A | 4/1992 | Roof et al. | |
| 5,143,472 | A | 9/1992 | Reed et al. | |
| 5,186,571 | A | 2/1993 | Hentzschel | |
| 5,215,290 | A | 6/1993 | Khalessi | |
| 5,437,433 | A | 8/1995 | Rezek | |
| 5,441,241 | A | 8/1995 | McKim | |
| 5,474,279 | A | 12/1995 | Parisien | |
| 5,544,865 | A | 8/1996 | Abbaticchio | |
| 5,547,169 | A | 8/1996 | Russell | |
| 5,564,248 | A | 10/1996 | Callies | |
| 5,695,174 | A | 12/1997 | Tsai | |
| 5,755,431 | A | 5/1998 | Williams | |
| 5,788,224 | A | 8/1998 | Platt | |
| 5,795,503 | A | 8/1998 | Krake | |
| 5,873,671 | A | 2/1999 | West | |
| 5,938,184 | A | 8/1999 | DeSouza | |
| 5,964,452 | A | 10/1999 | Summers | |
| 5,967,498 | A | 10/1999 | Junell | |
| 5,971,365 | A | 10/1999 | Pigott et al. | |
| 6,017,019 | A | 1/2000 | Erwin | |
| 6,029,954 | A | 2/2000 | Murdaca | |
| 6,039,307 | A | 3/2000 | De Zen | |
| 6,053,481 | A | 4/2000 | Scheide | |
| 6,131,358 | A | 10/2000 | Wise | |
| 6,173,944 | B1 | 1/2001 | McCarthy | |
| 6,308,937 | B1 | 10/2001 | Pettit | |
| 6,398,193 | B1 | 6/2002 | DeSouza | |
| 6,543,751 | B1 * | 4/2003 | Spruill | 256/65.04 |
| 6,601,831 | B2 | 8/2003 | Erwin | |
| 6,874,766 | B2 * | 4/2005 | Curatolo | 256/59 |
| 2002/0000545 | A1 | 1/2002 | Pettit et al. | |
| 2005/0127346 | A1 * | 6/2005 | Steffes | 256/65.05 |

FOREIGN PATENT DOCUMENTS

| | | | |
|---|---|---|---|
| DE | 3404-947 | A | 2/1984 |
| GB | 29939 | | 0/1897 |

* cited by examiner

RAIL BRACKET MOUNTING SYSTEM WITH LOCKING PIN

CROSS-REFERENCE TO RELATED APPLICATIONS

This application is a division of co-pending U.S. patent application Ser. No. 10/165,177, filed Jun. 6, 2002, entitled "Rail Bracket Mounting System With Locking Pin," which is a continuation of U.S. patent application Ser. No. 10/039,234, filed Dec. 31, 2001 now abn, entitled "Rail Bracket Mounting System," which is a continuation of U.S. patent application Ser. No. 09/919,502, filed Jul. 31, 2001 now abn, entitled "Rail Bracket Mounting System," which is a continuation-in-part of U.S. patent application Ser. No. 09/844,846, filed Apr. 28, 2001 now abn, entitled "Rail Bracket Mounting System," which applications are hereby incorporated by reference herein in their entireties, including but not limited to those portions that specifically appear hereinafter, the incorporation by reference being made with the following exception: In the event that any portion of the above-referenced applications is inconsistent with this application, this application supercedes said above-referenced applications.

STATEMENT REGARDING FEDERALLY SPONSORED RESEARCH OR DEVELOPMENT

Not Applicable

BACKGROUND OF THE INVENTION

1. The Field of the Invention

The present invention relates generally to a rail attachment bracket system, and more particularly, but not entirely, to a rail attachment bracket system that provides a uniquely effective attachment of a fence rail to a fence post.

2. Description of Related Art

It is a common practice to construct fencing from a system of vertical posts connected by horizontal rails to which pickets are attached. Commonly, these pieces are attached to each other with nails, screws, or nuts and bolts. These fasteners have a small surface area of contact against the piece fastened, resulting in a connection that may be insecure or easily disconnected. Such fasteners also protrude from the fence and can pose a safety risk by contact with the skin, resulting in cuts and abrasions. To attach a rail to a post using these conventional fasteners requires that the rail be separately supported until the rail is secured to the post. A user is thus required to use a separate means to support the rail, before screwing or belting the rail to the post. This is laborious and time consuming.

Attempts have been made in the prior art to provide alternatives to the conventional fasteners. U.S. Pat. No. 5,873,671, granted Feb. 23, 1999 to West (herein after the "'671 patent") discloses a rail attachment bracket with a snap on cover. The '671 bracket consists of a internal support member that is attached to a vertical post, and the open end of a hollow rail is slipped over the internal support member of the bracket. The rail may be secured to the internal support, and a snap-on cover is placed over the rail and internal support connection.

One advantage of the '671 bracket is that once the rail is installed on the bracket, the bracket provides independent support to the rail. Another advantage is that when the rail is secured to the bracket, the fasteners are then covered by the snap-on cover and concealed from view for a more aesthetically pleasing look. However, the rail is supported internally and without any external support. This both limits the bracket to use with a hollow rail with an adequately large opening and also places the weight of the rail against the inside of the top wall of the rail. If additional pressure is placed on the rail, the top wall can fail, requiring the rail to be replaced. The internal support also interferes with the placement of longitudinal reinforcing structure inside the rail.

Reinforcement means for a hollow fence rail have been commonly provided by placing a metal rod within the fence rail, such that the rod extends throughout the entire length of the rail. Such a fence rail is attached to the posts by aligning the protruding end of the metal rod with an opening in the post, and thereafter securing the rail to the post with screws. This arrangement still requires the user to provide separate support for the rail until the attachment is secured, and leaves the head of the screws exposed. It also requires the user to align the rail to the post so the rod may enter the opening.

It is noteworthy that none of the prior art known to applicant provides a rail bracket system capable of holding the rail in position for attachment to the post, without requiring separate support of the rail to accomplish the attachment.

The prior art is thus characterized by several disadvantages that are addressed by the present invention. The present invention minimizes, and in some aspects eliminates, the above-mentioned failures, and other problems, by utilizing the methods and structural features described herein.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
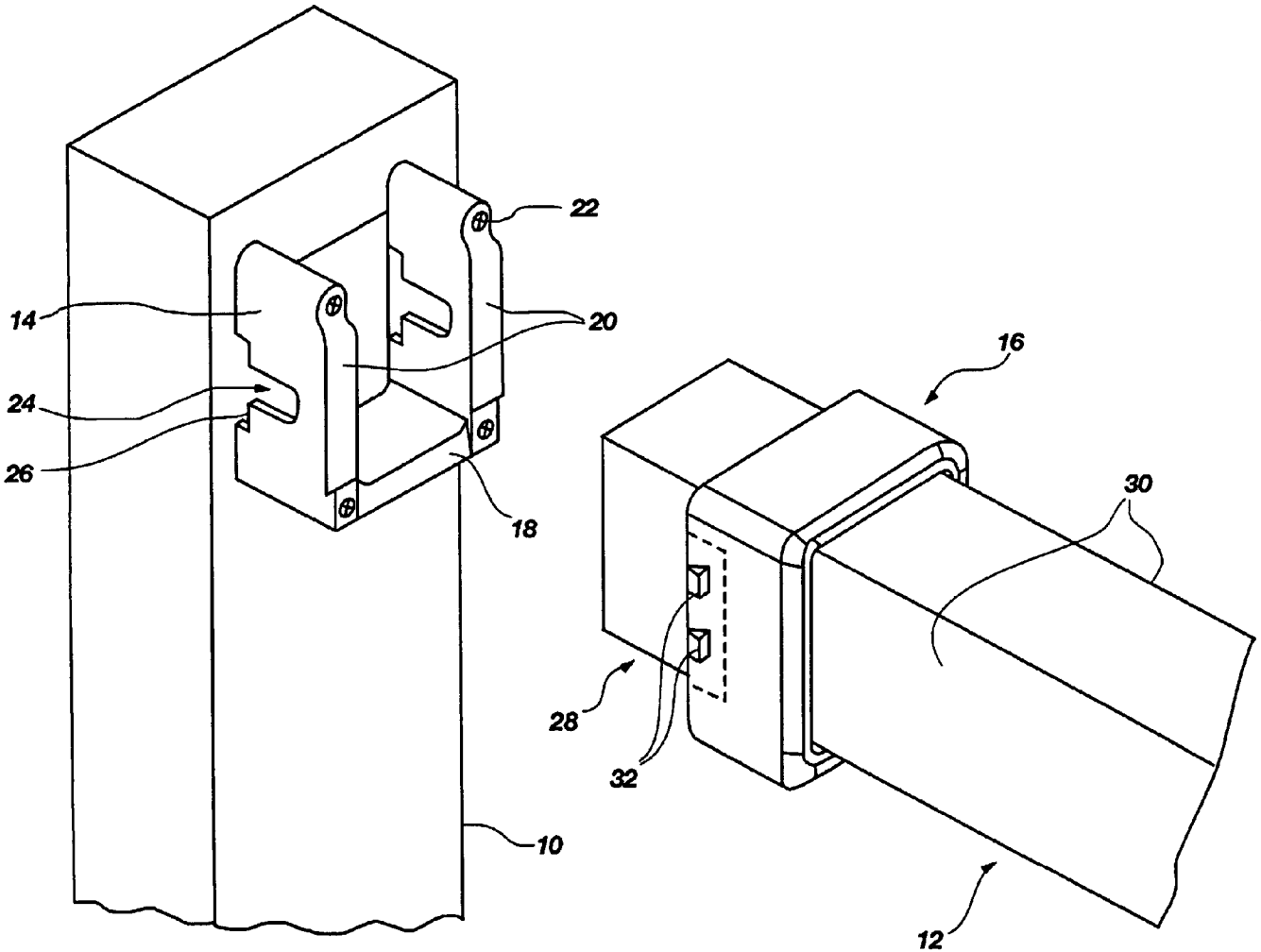
FIG. 1 is a perspective, break-away view of a rail bracket mounting system made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Figure 2:
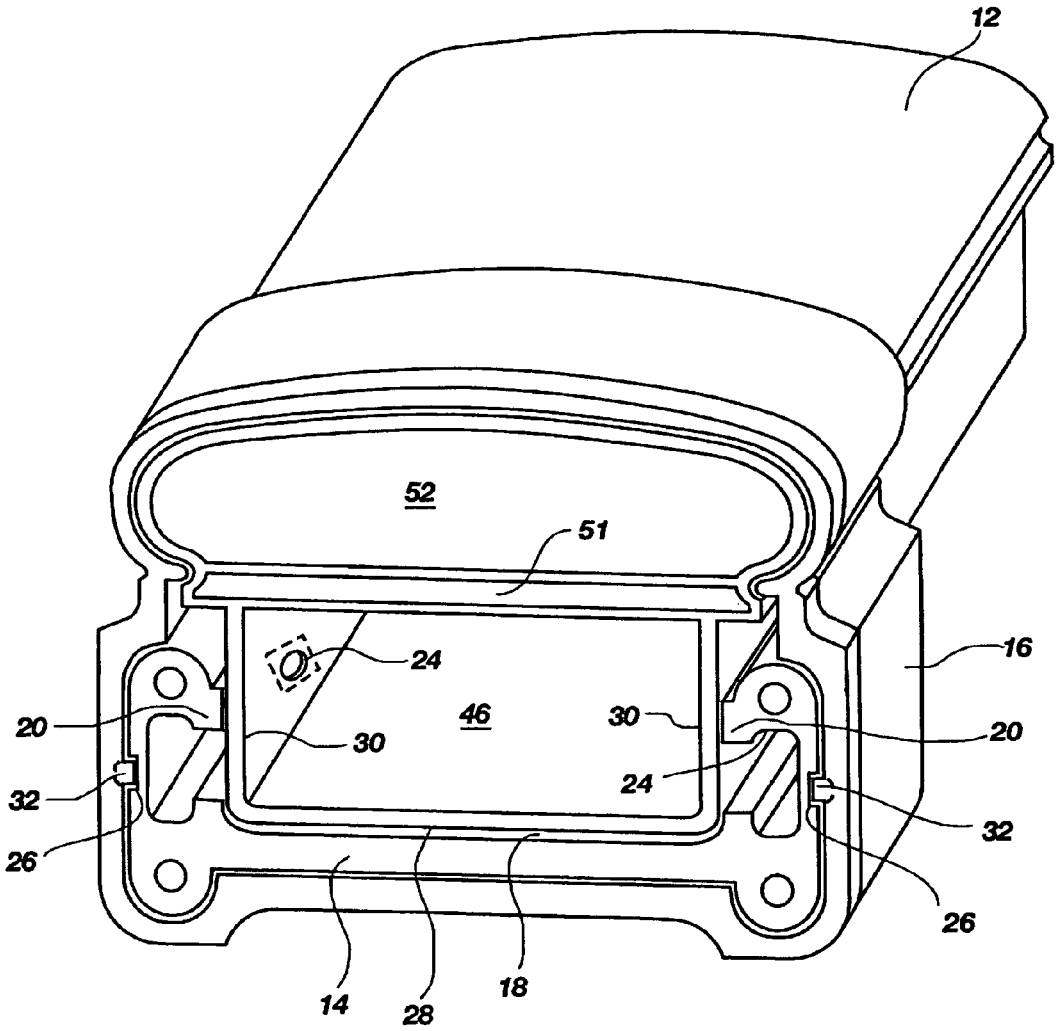
FIG. 2 is a frontal view of another embodiment of a rail bracket mounting system of made in accordance with the principles of the present invention.
Figure 3:
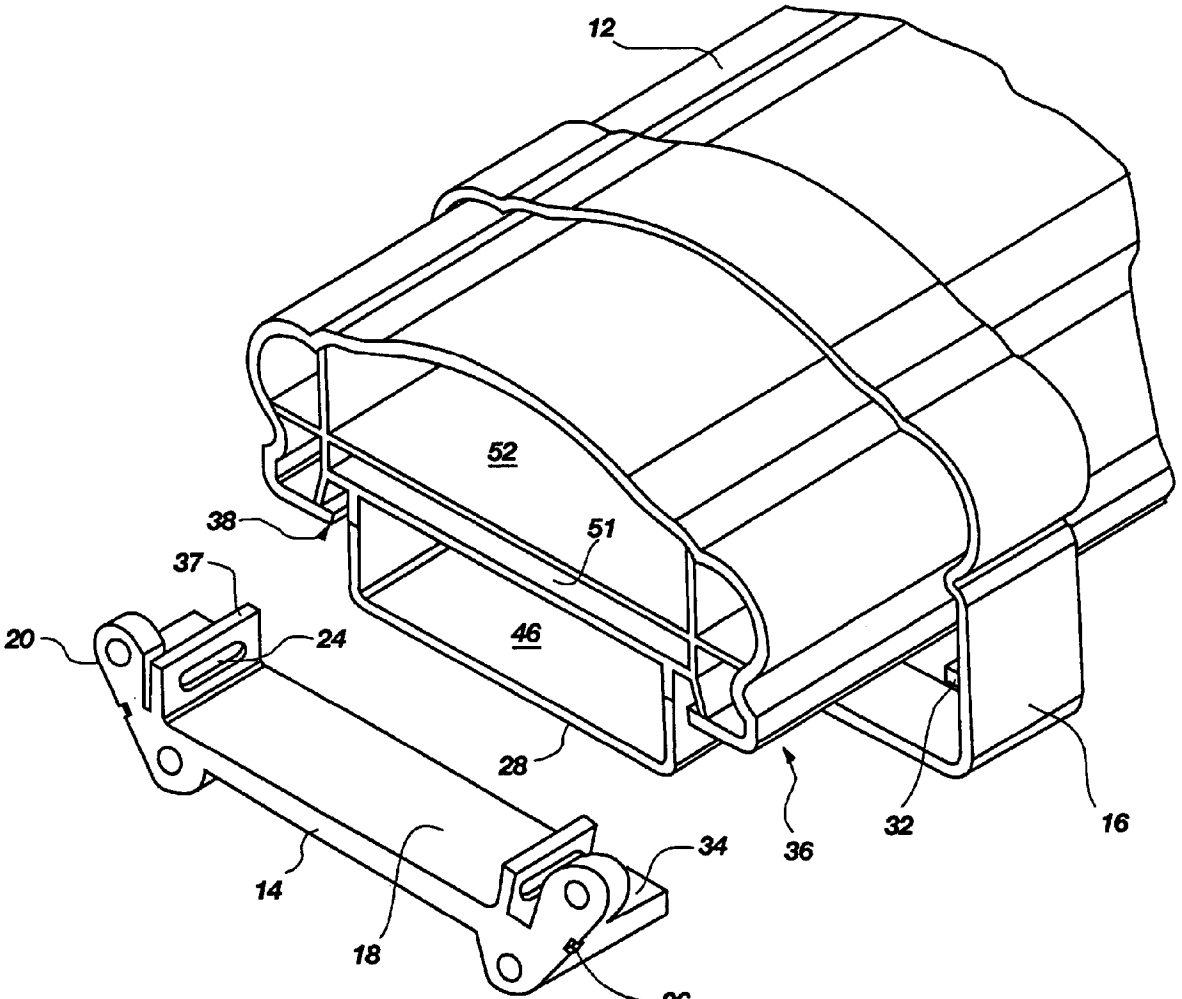
FIG. 3 is a perspective, break-away view of another embodiment of a rail bracket mounting system, made in accordance the principles of the present invention.

The invention is directed to a system for attaching fence members together with a bracket. FIGS. 1–3 show some of the possible embodiments of the invention. The support bracket 14 is attached to the post 10, also sometimes referred to herein as a fence rail support. In the embodiment shown in FIG. 1, the bracket has been attached by screws 22 inserted in through-bores 23, but any suitable method to attach the bracket 14 to the post 10, such as nails, bolts, or the use of a chemical adhesive will suffice. Note that in the embodiments of FIGS. 2, 3, and 4 the post 10 is not shown in order to more clearly show the rail bracket mounting system. In one preferred embodiment, the post is a PVC fence post, but any post constructed of suitable material will suffice. The bracket 14 features a bottom ledge 18 which is constructed to support the weight of a rail. Rail 12 is placed into the bracket 14. In the preferred embodiment, the rail 12 is placed into two brackets 14, one at each end of the rail 12. This allows the rail to be cut to the exact length needed. When the rail 12 is placed into the bracket, the bottom wall 28 of the rail 12 is placed on top of the bottom ledge 18, and the side walls 30 of the rail 12, lie adjacent to at least a portion of the side supports 20 of the bracket 14. The rail 12 is thus "nested" in the bracket. It will be appreciated that any number of alternative shapes for the rail 12 and bracket 14 are possible, including a rail 12 that is cylindrical or octagonal in shape, or a rail having a decorative portion above the bracket, among many others, with a bracket 14 that is similarly configured. In any embodiment the bracket 14 preferably supports the rail 12 at least in part from a point on the bottom surface 28 of the rail. It will be appreciated that all such variations of the shape of the rail 12 and bracket 14 are within the scope of the present invention.

It will be appreciated that in some preferred embodiments, the side supports 20 of the bracket 14 are configured to help support the rail 12. The side supports 20 may also be configured to secure the rail 12 in the bracket 14. This is most clearly demonstrated by the embodiment shown in FIG. 3. The side supports 20 of this embodiment include a flat surface 34 and a ridge 37. When the rail 12 is nested in the bracket 14, the sidewalls 30 of the rail are held between the ridges 37. The top surface of the ridges 37 enter a channel 38 on the rail 12 acting to secure the rail in the bracket. Optionally, the rail 12 may be configured to engage in an interference fit with the bracket, for example by modification of the channel and ridge structure that is depicted in FIG. 3. The side supports 20, of the embodiment of FIG. 3 also feature a flat surface 34. When the rail 12 is nested in the bracket 14, the flat surface 34 lies underneath a corresponding bottom side surface 36 on the rail 12, providing additional support for the rail. It will be appreciated that other configurations of the bracket 14, including the side supports 20 and the rail 12, including structures for interacting with the bracket 14 so as to be secured in the bracket 14 or supported by the side supports 20, are readily ascertainable to those skilled in the art, from the teachings herein and are included within the scope of the present invention.

When the rail 12 is nested in the bracket 14, the bracket holds and supports the rail. If the rail 12 is nested in a bracket 14 at both ends, the rail 12 is completely supported against downward vertical displacement. Once the rail 12 has been nested in the bracket 14, the rail may be secured to the bracket 14. In the embodiments of FIGS. 1–3, this may be accomplished by attaching a connector, such as a screw through the opening 24 in the side support 20 of the bracket 14. It will be appreciated that many alternative structures can be used to secure the rail 12 to the bracket 14, and that such structures are within the scope of the present invention.

Once the rail 12 has been secured, a cover 16, also sometimes referred to herein as "trim", may be used to conceal the connector used to secure the rail 12 to the bracket 14. In such an embodiment, the cover 16 is first placed onto the rail 12 such as in the manner shown in FIG. 3, prior to the rail 12 being nested in the bracket 14. Once the rail 12 is nested within the bracket 14, the cover 16 is then slid along the rail 12 and over the bracket 14. The cover 16 may, if desired, be designed to attach to the bracket 14 by the interaction of cover projections 32 with receiving openings 26 located on the side wall 20 of the bracket 14. This is best shown in the embodiment of FIG. 2, which depicts a cover 16 in the installed position relative to the bracket 14. It will be appreciated that many alternative structures, readily ascertainable to those skilled in the art, can suffice to attach the cover 16 to the bracket 14, and that such structures are within the scope of the present invention.

By providing a bracket 14 attached to a post 10, in which the rail 12 may be nested prior to securing the rail 12 to the bracket 14, the present invention accomplishes the object of holding the rail 12 during the attachment of the rail 12 to the post 10 in a fence system. This provides an advantage over the prior art, in which the rail must be supported by some means other than the bracket during the installation procedure to attach the fence rail to the fence post. By supporting the rail 12 beneath its lowest portion, the system allows the rail 12 to span the length of the space between the posts and have support that is less likely to weaken the rail. This is an advantage over the device disclosed in the '671 patent, described in the background section above, which requires the rail 12 to be shorter than the space between the rails, so that internal supports may be inserted into the rail. The present invention also avoids focusing the stress on the internal surface of the top wall of a hollow rail, and allows the system to be used with a solid rail 12 (as represented in FIG. 1.), both of which are advantages over the '671 patent. The rail 12 of the embodiments of FIGS. 2, 3 and 4 are hollow, illustrating the versatility of the invention.

Figure 4:
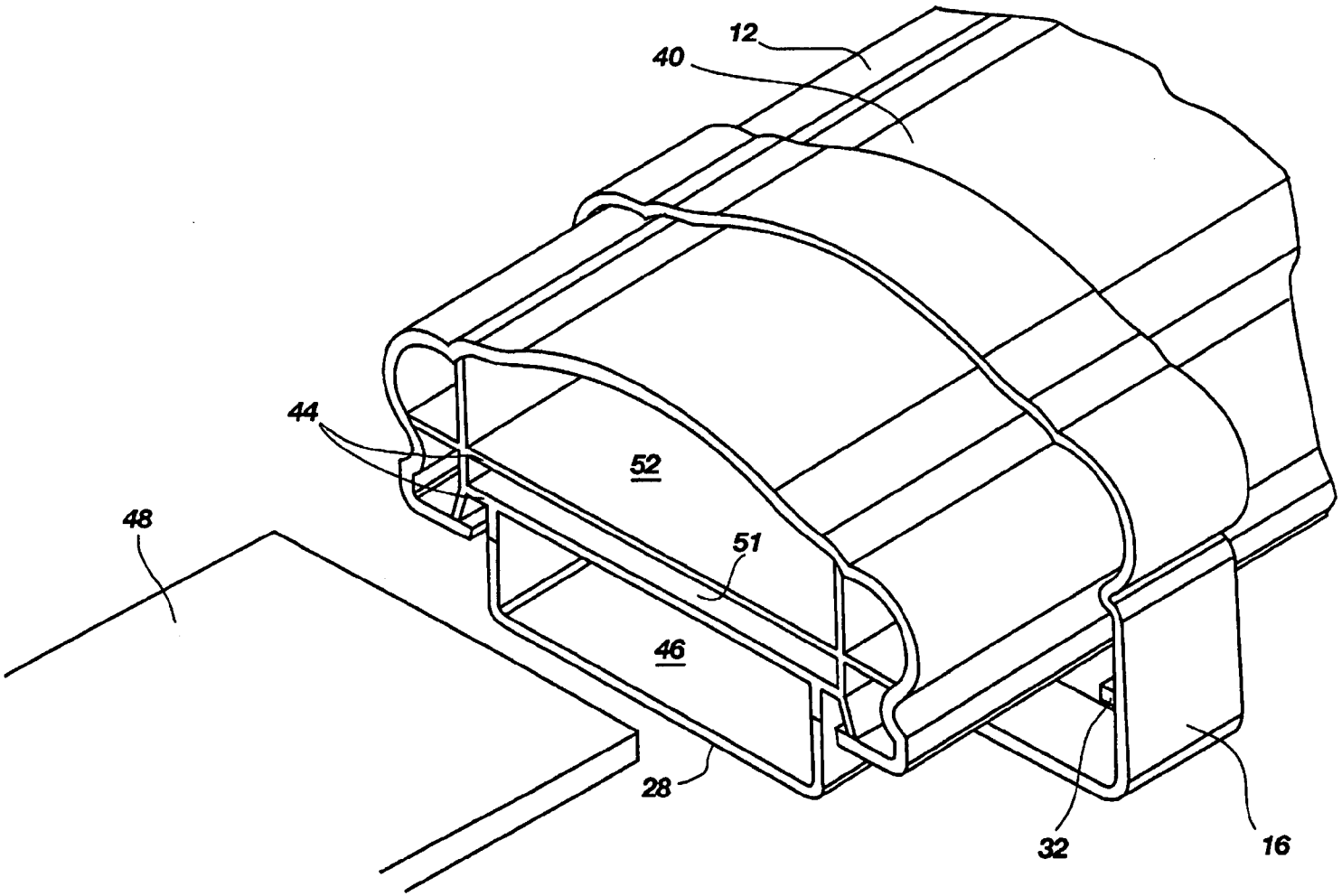
FIG. 4 is a perspective, break away view of another embodiment of the rail bracket mounting system of FIG. 3.

Referring now to FIG. 4, there is shown an alternative structure for the rail 12, which may be used in an embodiment of the present invention. Unlike the rail 12 of FIG. 2, which may be solid in construction, rail 12 is hollow. Preferably, rail 12 is constructed of PVC and is used as part of a PVC picket fence system, although it may be constructed of any suitable material. Rail 12 has a decorative top portion, generally indicated at 42, and contains internal walls 44 which divide the hollow interior. Reinforcement cavities 46, 51 and 52 are contained within the rail 40. The reinforcement cavities are defined by the bottom wall 49 of the rail 40 and internal walls 44. It will be appreciated that a reinforcement cavity may comprise the entire interior or there may be a plurality of reinforcement cavities as shown to provide additional reinforcement. A reinforcement member 48 may be inserted into the cavity 46. The reinforcement member 48 is preferably formed to fill the entire reenforcement cavity 46, but need not do so. The reinforcement member 48 may be constructed of any material capable of giving additional strength to the rail 12. The preferred materials for the reinforcement member 48 are steel and aluminum. The reinforcement member 48 may extend the entire length of the rail 12. FIG. 1 also shows reinforcement cavities 46, 51 and 52.

By using a rail 12 that is reinforced throughout its length, in a mounting system such as that in FIGS. 2, 3 or 4, the invention combines the advantages of a reinforced rail, with the advantages of a nesting mounting system.

In accordance with the features and combinations described above, one preferred method of attaching members in a fence system comprising upwardly-extending fence posts and laterally-extending fence rails includes the steps of:

(a) selecting a first non-metallic fence bracket configured to be attached to a fence post that is upwardly-extending in orientation, the first non-metallic bracket further comprising at least a first ledge and at least two sides;

the ledge disposed to reside beneath the lowest point of a laterally-extending fence rail inserted into said first non-metallic bracket, each side disposed to support at least a portion of a side of said rail;

such that said first non-metallic bracket is capable of supporting the rail when an end of the rail is inserted therein;

(b) attaching the bracket to the post;

(c) selecting a fence rail and placing a first end of the rail into the non-metallic bracket, such that the rail is supported by the non-metallic bracket; and (d) securing the rail to the bracket.

It is further preferred to practice this method by attaching a second non-metallic bracket to a second post and insert the second end of the rail into the second non-metallic bracket, such that the rail is entirely supported by the first and second non-metallic brackets, then securing the rail to the first and second non-metallic brackets.

Also in accordance with the features and combinations described above, another preferred method of attaching members in fence system comprising upwardly-extending fence posts and laterally-extending fence rails includes the steps of:

(a) selecting a first bracket configured to be attached to a fence post that is upwardly-extending in orientation, the first bracket further comprising at least a first ledge and at least two sides;

the ledge disposed to reside beneath the lowest point of a first end of a laterally-extending fence rail inserted into said first bracket, each side disposed to support at least a portion of a side of one end of said rail;

such that said first bracket is capable of supporting the rail when an end of the rail is inserted therein;

(b) attaching the first bracket to the post;

(c) selecting a fence rail and placing a first end of the rail into the first bracket, such that the rail is supported by the first bracket;

(d) securing the rail to the first bracket;

(e) selecting a bracket cover designed and configured to attach to the first bracket and conceal the attachment of the rail to the first bracket, said cover comprising at least one fastening structure, such that when the cover is attached to the bracket, the fastening structure interacts with the receiving structure to secure the cover to the bracket; and (f) attaching the cover to the first bracket.

In a more preferred embodiment, this method further comprises attaching a second bracket to a second post, and inserting the second end of the rail into the second bracket, such that the rail is entirely supported by the first and second, then securing the rail to the first and second brackets, and selecting and attaching a second bracket cover to the second bracket.

It will be appreciated that the structures and methods included in the present invention thus provide a rail bracket mounting system that is simple in design and operation and is capable of being used with a hollow rail or a solid rail. It will be further appreciated that certain embodiments of the present invention provide a rail bracket mounting system that supports the rail during attachment so the rail may be secured without separate support and some embodiments of the present invention provide such a rail bracket mounting system that provides a means to guide a rail into alignment with the post.

It will also be appreciated that the present invention, in some embodiments provides a support means that resides below the lowest portion of the rail. Other embodiments provide a means by which a hollow rail may be reinforced along its entire length. It will also be appreciated that the present invention, in accordance with one aspect thereof, provides a rail bracket mounting system in which the securing fasteners are not exposed.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

Figure 5:
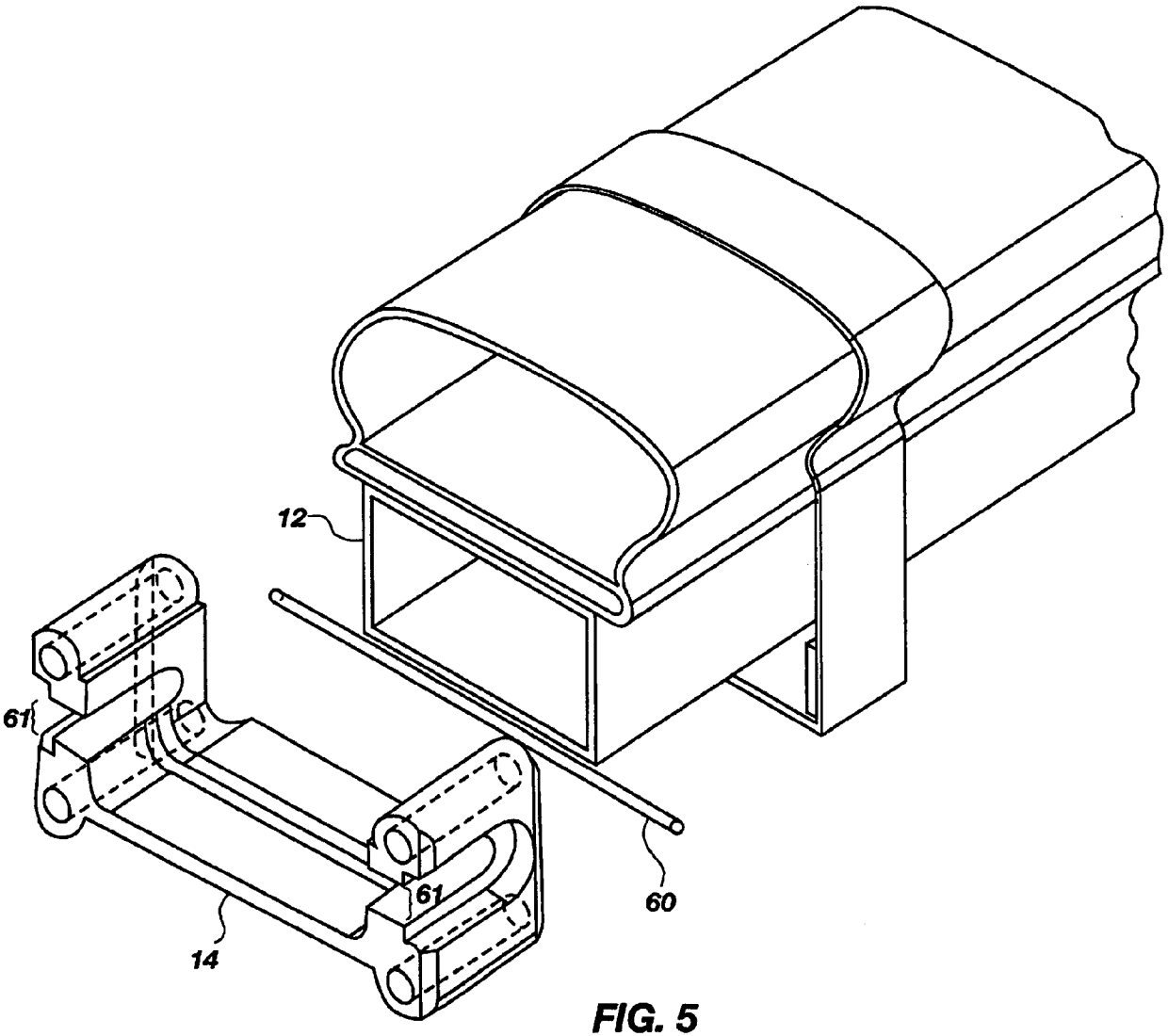
FIG. 5 is an exploded perspective view of another embodiment of the rail bracket mounting system of FIG. 1.

Referring now to FIG. 5, there is shown a perspective view of an alternative embodiment of the fastener used to attach the rail 12 to the bracket 14. The rail 12 and bracket 14 shown in FIG. 5 are substantially the same as the embodiment of FIG. 2, with the exception that the bracket 14 in FIG. 5 has slot openings 61 formed in the bracket 14. In this embodiment, a pin 60 acts as the fastener that extends through the holes 62 of fence rail 12 to attach the rail 12 to the bracket 14 by engagement of the pin 60 against the bracket edges that form the opening 24. The pin 60 may comprise a 3/16 inch stainless steel rod, but may also be constructed of any suitable material known to those skilled in the art. It will be appreciated that the pin 60 can be used as a fastener in all of the various embodiments of the invention, and may have a smooth exterior surface characterized by an absence of threads.

Figure 6:
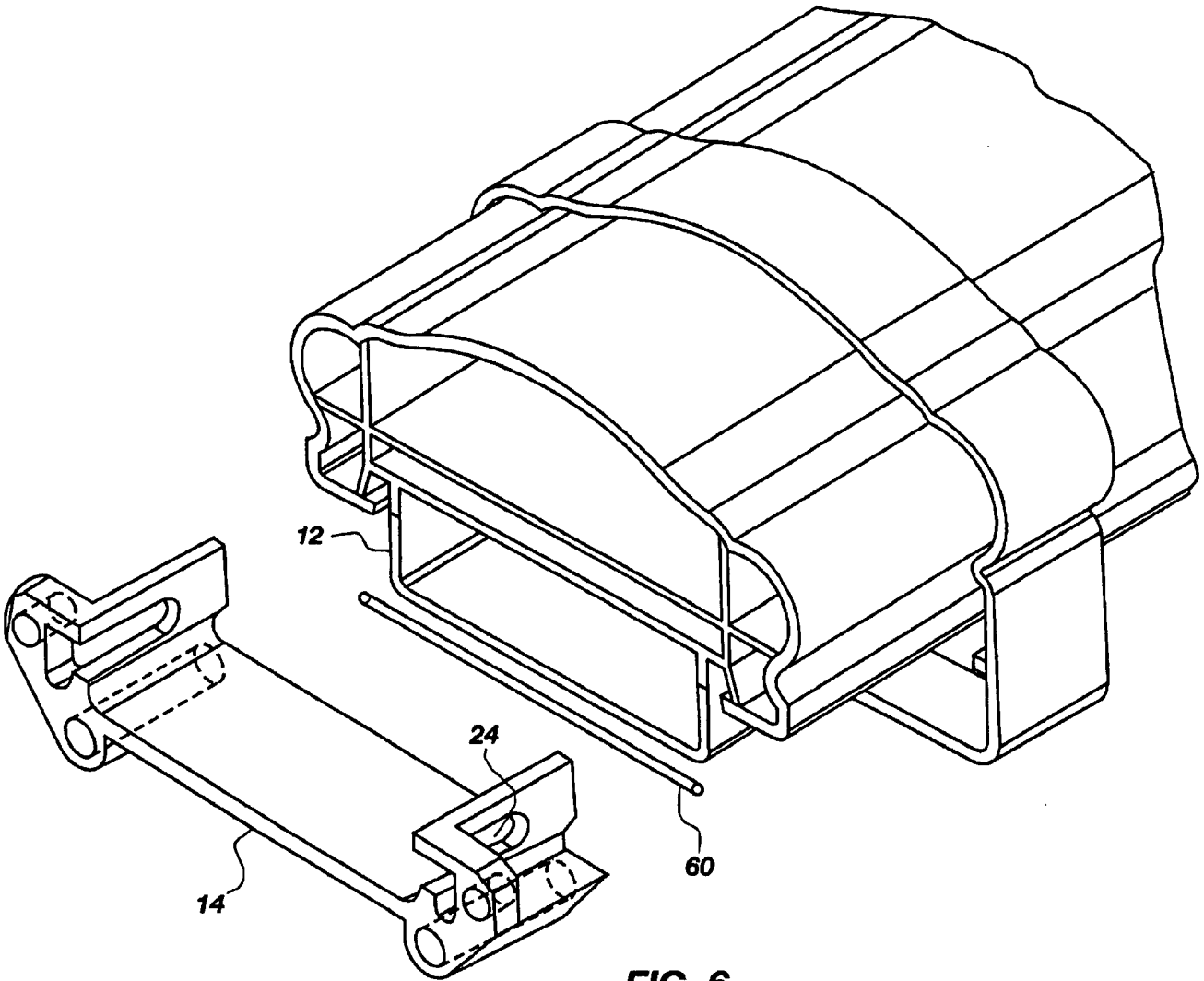
FIG. 6 is an exploded perspective view of another embodiment of the rail bracket mounting system of FIG. 3.

Referring now to FIG. 6, there is shown a perspective view of the rail 12 and bracket 14 embodiment of FIG. 3, with the addition of a pin 60, wherein the pin 60 is used to attach the rail 12 to the bracket 14. The embodiment in FIG. 6 has substantially the same bracket 14 as the embodiment of FIG. 3, with the exception that the opening 24 in the bracket 14 of the embodiment in FIG. 6 is a different shape than the opening 24 in the bracket 14 in the embodiment shown in FIG. 3.

Figure 7:
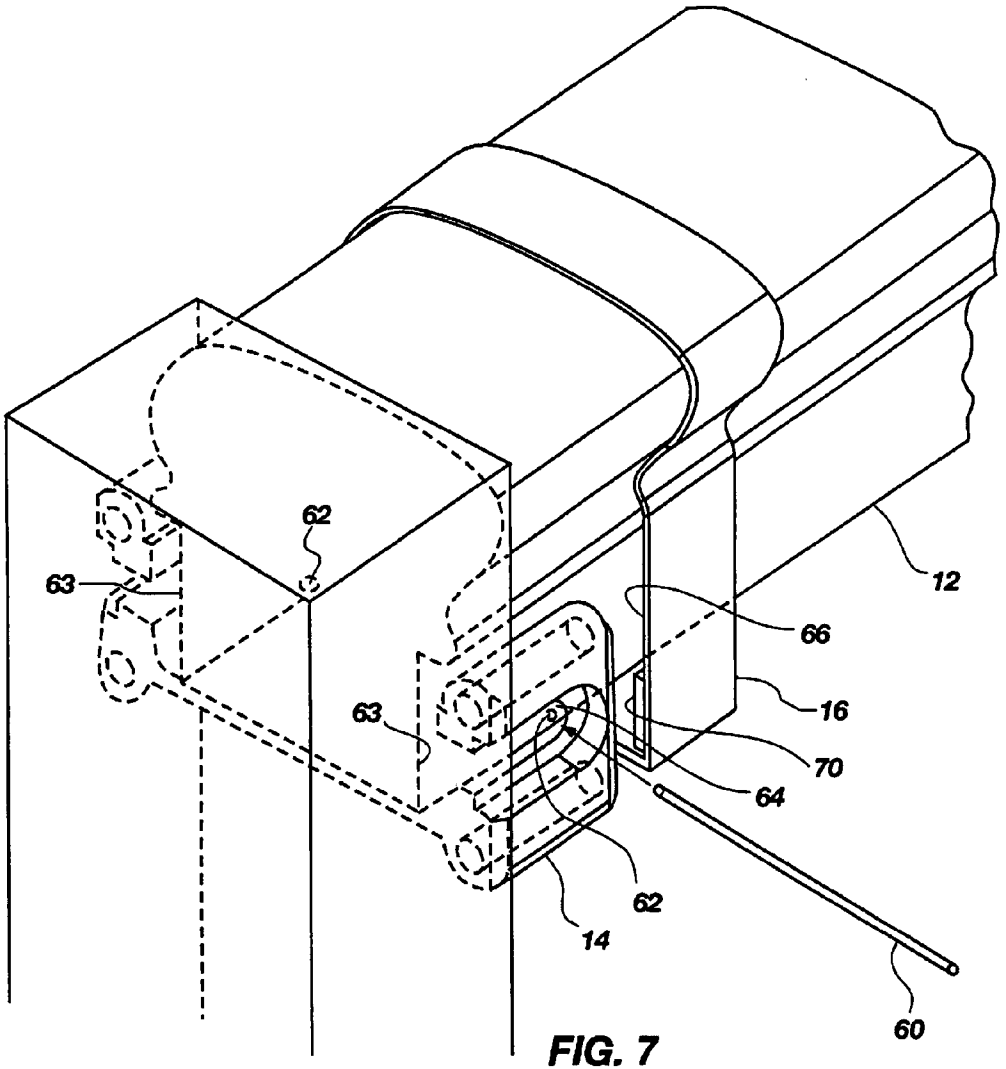
FIG. 7 shows the system of FIG. 5 in a partially assembled arrangement.

Referring now to FIG. 7, there is shown a perspective view of the pin 60 being inserted into the rail 12 and bracket 14 of the embodiment shown in FIG. 5. The rail 12 is inserted and nested into the bracket 14 in the same manner as described previously. In this embodiment, the rail 12 is attached to the bracket 14 in the following manner. A hole 62 is preferably drilled into a side of the rail 12, preferably a hollow rail 12, by the person installing the fence at the fence assembly site. Preferably, the hole 62 is located ⅛ inch from the bracket 14 as indicated in FIG. 7 by the space designated as reference numeral 64. A second hole 62 is then drilled into the opposite side of the rail in the same manner as the first hole 62. It will be appreciated to those skilled in the art that the pin 60 could also be attached in any other suitable manner. The ⅛ inch space accommodates expansion and contraction of the material used to construct the rail 12 and bracket 14. The pin 60 provides an advantage over a screw fastener because the smooth surface of the pin 60 will not cut into the material used to construct the rail 12 like the sharp edges of a screw. Repeated contraction and expansion of the rail 12 causes the sharp edges of a screw to form a stress point, which over time can cause the rail 12 to fail.

Referring again to FIG. 7, the pin 60 is held into place by the cover 16, after the cover 16 is snapped into place onto the bracket 14 with interference tabs 70. Preferably, the pin 60 is of a length substantially the same distance as the width between the two inside edges 66 of the cover 16. The length of the pin 60 allows the two ends of the pin 60 to extend past the two outer edges 63 of the rail 12 and contact the inside edges 67 of the bracket 14 to prevent the rail 12 from sliding out of the bracket 14. Once the pin 60 has been inserted into the rail 12, the cover 16 is slid into place. The inside edges 66 of the cover 16 prevents the pin 60 from sliding out of the rail 12.

The use of the pin 60 to secure the rail 12 to the bracket 14 provides the fence installer with more versatility. For instance, the use of the pin 60 makes attachment of a rail 12 to a bracket 14 easier when the rail 12 is being installed at an angle, such as on a stairway where the rail 12 is attached to the bracket 14 at an angle.

The term "intercoupling" as used herein, such as in the phrase "intercoupling means for intercoupling the fence rail and said fence rail support," shall be construed broadly to refer to any means or method of providing a mechanical contact connection between at least two members, regardless of whether said connection is an interference fit connection, or a frictional connection, or some other contact connection. For example, the rail bracket operates to intercouple the fence rail to the fence post, with or without the pin member or snap-on trim, simply by being attached to the fence post and serving as a type of tray on which the fence rail may rest. Therefore, even though the fence rail may be easily lifted off of the rail bracket if the pin member and snap-on trim are not used, the bracket nonetheless operates to intercouple the fence rail to the fence post by supporting the rail in the manner of a type of tray connected to the post.

From the descriptions above, it will be appreciated that one feature of the present invention is to provide a rail bracket mounting system that is simple in design and operation.

It is another feature of the present invention, in accordance with one aspect thereof, to provide a rail bracket mounting system that supports the rail during attachment, such that the rail may be secured without separate support.

It is another feature of the present invention, in accordance with one aspect thereof, to provide such a rail bracket mounting system that includes a means to guide a rail into alignment with the post.

It is a further feature of the present invention, in accordance with one aspect thereof, to provide a support means that resides below the lowest portion of the rail.

It is an additional feature of the invention, in accordance with one aspect thereof, to provide a rail bracket mounting system capable of being used with either a hollow rail or a solid rail.

It is also a feature of the invention, in accordance with one aspect thereof, to provide a means by which a hollow rail may be reinforced along its entire length.

It is another feature of the invention, in accordance with one aspect thereof, to provide a rail bracket mounting system in which the securing fasteners are not exposed.

Additional features and advantages of the invention have either been set forth in the foregoing description or are apparent from it, or may be learned by the practice of the invention without undue experimentation. The features and advantages of the invention may be realized and obtained by means of the instruments and combinations particularly pointed out in the appended claims.

What is claimed is:

1. A method for securing a fence rail to a fence rail support, comprising:

(a) attaching a bracket member to an upwardly-extending fence rail support;

(b) placing a free end of a fence rail into engagement with the bracket member; and (c) sliding a smooth pin member through a plurality of elongate slot openings formed in the bracket member and openings in the rail when said elongate slot openings and openings in the rail are all disposed in alignment with one another, said pin member being characterized by an absence of male threads formed thereon, such that said pin member operates to prevent the fence rail from separating from the bracket member, and wherein said pin member is allowed to move in said elongate slot openings to allow said fence rail to move with respect to said bracket.

2. The method of claim 1, wherein part (b) further comprises placing said free end of said fence rail on top of a support surface of the bracket member.

3. A method for securing a fence rail to a fence rail support, comprising:

(a) attaching a bracket member to an upwardly-extending fence rail support;

(b) placing a free end of a fence rail into engagement with the bracket member; and (c) sliding a smooth pin member through a plurality of openings formed in the bracket member and in the rail when said openings are all disposed in alignment with one another, said pin member being characterized by an absence of male threads formed thereon, such that said pin member operates to prevent the fence rail from separating from the bracket member;

wherein part (b) further comprises sliding a trim member onto the free end of the fence rail before placing the fence rail onto the bracket member.

4. The method of claim 3, further comprising:

(d) sliding the trim member along the fence rail and from said rail onto the bracket member and snapping the trim member into engagement with the bracket member such that an interference fit exists between said trim member and the bracket member, wherein the trim member is thereby positioned to block removal of the pin member from the opening into which it resides.

5. The method of claim 3, wherein step (c) further comprises drilling two openings into the fence rail before sliding the smooth pin member through the plurality of openings.

6. The method of claim 3, wherein the pin member further comprises a substantially straight member.

7. The method of claim 3, wherein the pin member further comprises a substantially straight member having a uniform thickness along a majority length thereof.

8. A method for securing a fence rail to a fence rail support, comprising:

(a) intercoupling the fence rail and the fence rail support by sliding a first pin member through at least two openings formed in the fence rail and at least two elongate slot openings formed in an intercoupling means, such that said first pin member resides simultaneously within all of said at least two openings in the fence rail and said at least two elongate slot openings in the intercoupling means, to thereby block movement of the fence rail in at least a first direction with respect to the intercoupling means, and allow movement of the pin member with respect to the elongate slot openings to allow the fence rail to move with respect to the intercoupling means.

9. The method of claim 8, wherein part (a) further comprises the step of aligning all of the at least two openings in the fence rail and the at least two elongate slot openings in the intercoupling means, such that all said openings are bisected by an imaginary straight line.

10. The method of claim 8, wherein said intercoupling means comprises opposing side supports and said method further comprises inserting said fence rail between said opposing side supports.

11. The method of claim 8, wherein said intercoupling means comprises a bottom ledge and said method further comprises placing said fence rail on said bottom ledge.

12. The method of claim 8, further comprising concealing said intercoupling means with a cover.

13. The method of claim 12, further comprising connecting said cover to said intercoupling means.

14. A method for securing a fence rail to a fence rail support, said method comprising the steps of:

(a) attaching a bracket member to said fence rail support;

(b) placing a free end of said fence rail into engagement with the bracket member;

(c) sliding a pin member through an opening formed in the bracket member and an opening formed in the rail; and (d) placing a cover over said pin member for concealing said pin member and maintaining said pin member in position.

15. The method of claim 14, further comprising extending said pin member beyond opposing sides of said rail.

16. The method of claim 14, further comprising concealing said bracket member with said cover.

17. The method of claim 14, wherein step (b) further comprises inserting said fence rail between opposing side supports of said bracket member.

18. The method of claim 14, wherein step (b) further comprises placing said fence rail on a bottom ledge of said bracket member.

19. The method of claim 14, further comprising connecting said cover to said bracket.

20. The method of claim 14, further comprising enclosing a perimeter of a portion of said rail with said cover.

21. The method of claim 14, wherein step (d) further comprises placing said cover over both ends of said pin member to maintain engagement of said pin member with said bracket member.

22. A method for securing a fence rail to a fence rail support, comprising:

(a) intercoupling the fence rail and the fence rail support by sliding a first pin member through at least two openings formed in the fence rail and at least two openings formed in an intercoupling means, such that said first pin member resides simultaneously within all of said at least two openings in the fence rail and said at least two openings in the intercoupling means, to thereby block movement of the fence rail in at least a first direction with respect to the intercoupling means;

(b) concealing said intercoupling means with a cover and enclosing a perimeter of a portion of said rail with said cover.

23. A method for securing a fence rail to a fence rail support, comprising:

(a) intercoupling the fence rail and the fence rail support by sliding a first pin member through at least two openings formed in the fence rail and at least two openings formed in an intercoupling means, such that said first pin member resides simultaneously within all of said at least two openings in the fence rail and said at least two openings in the intercoupling means, to thereby block movement of the fence rail in at least a first direction with respect to the intercoupling means;

(b) concealing said intercoupling means with a cover and placing said cover over both ends of said pin member to maintain engagement of said pin member with said intercoupling means.

24. A method for securing a fence rail to a fence rail support, comprising:

(a) attaching a bracket member to a first side of an upwardly-extending fence rail support, said bracket member comprising side supports for supporting opposing sides of said fence rail;

(b) placing a free end of a fence rail into engagement with the bracket member such that said free end of said fence rail faces said first side of said rail support; and (c) sliding a smooth pin member through a plurality of openings formed in the bracket member and in the rail when said openings are all disposed in alignment with one another, said pin member being characterized by an absence of male threads formed thereon, such that said pin member operates to prevent the fence rail from separating from the bracket member;

wherein attaching said bracket member to said upwardly-extending fence rail support further comprises inserting fasteners through said side supports into said first side of said rail support.

25. A method for securing a fence rail to a fence rail support, comprising:

(a) intercoupling the fence rail and the fence rail support on a first side of the fence rail support by sliding a first pin member through at least two openings formed in the fence rail and at least two openings formed in an intercoupling means, such that said first pin member resides simultaneously within all of said at least two openings in the fence rail and said at least two openings in the intercoupling means, to thereby block movement of the fence rail in at least a first direction with respect to the intercoupling means;

wherein said intercoupling means comprises opposing side supports for supporting opposing sides of said fence real, and said method further comprises fastening said intercoupling means to said fence rail support by inserting fasteners through said side supports into said first side of said fence rail support.

* * * * *